US005571075A

United States Patent [19]

Bullard

[11] Patent Number: 5,571,075

[45] Date of Patent: Nov. 5, 1996

[54] METHOD FOR EXERCISE AND SIMULTANEOUS MOVEMENT OF BLOOD BY EXTERNAL PRESSURE

[76] Inventor: Horace Bullard, 3333 Henry Hudson Pkwy., Riverdale, N.Y. 10463

[21] Appl. No.: 431,127

[22] Filed: Apr. 28, 1995

[51] Int. Cl.[6] ..... A61H 9/00

[52] U.S. Cl. ..... 601/152; 601/24; 601/151

[58] Field of Search ..... 601/5, 6, 11, 15, 601/149, 150, 151, 152, 23, 24; 602/13; 128/DIG. 20; 482/8, 13

[56] References Cited

U.S. PATENT DOCUMENTS

| | | | |
|---|---|---|---|
| 3,670,723 | 6/1972 | Simjian | 601/152 |
| 4,121,583 | 10/1978 | Chen | 483/13 |
| 4,941,458 | 7/1990 | Taheri | 601/152 |
| 5,027,797 | 7/1991 | Bullard | 601/150 |
| 5,092,317 | 3/1992 | Zelkovski | 601/152 |
| 5,137,017 | 8/1992 | Salter | 128/204.26 |
| 5,280,780 | 1/1994 | Abel | 128/205.24 |
| 5,462,504 | 10/1995 | Trulaske | 482/8 |

FOREIGN PATENT DOCUMENTS

| | | | |
|---|---|---|---|
| 1066596 | 1/1984 | U.S.S.R. | 601/152 |
| 1358954 | 12/1987 | U.S.S.R. | 601/151 |

OTHER PUBLICATIONS

Alvan L. Barach, M.D., "Pulmonary Emphysema", received May 1966.

*Primary Examiner*—Richard J. Apley
*Assistant Examiner*—Jeanne M. Clark
*Attorney, Agent, or Firm*—Eliot S. Gerber

[57] ABSTRACT

A method for vascular exercise involves the subject performing physical exercise to raise his heart rate at least 25% above his normal rate. Then a series of air-inflatable bladders (cuffs) on the subject's limbs are inflated in sequence, starting with the bladder furthest from the trunk, to force blood toward the trunk. Preferably a nose clip feeds oxygen to the subject during the physical exercise, and the subject lies prone with his legs raised, during the inflation of the bladders on the legs.

26 Claims, 4 Drawing Sheets

METHOD FOR EXERCISE AND SIMULTANEOUS MOVEMENT OF BLOOD BY EXTERNAL PRESSURE

BACKGROUND OF THE INVENTION

1. Field of the Invention

The present invention relates to methods and an apparatus for an exercise program involving temporarily increasing the amount of blood in a person's trunk portion while simultaneously physically exercising and protecting the person's venous valves.

2. Description of the Related Art

It is known that beneficial effects and feeling of health are provided by massaging parts of the human body. Such massaging may be performed by a mechanical apparatus, for example, as shown in U.S. Pat. No. 3,908,642 for "Means for Aerating And Applying Air Pulsations Within Casts". That patent describes an arrangement of diaphragms (bladders) installed within a cast.

It is also known that persons with "varicose veins" may be helped by compressing the leg veins by means of elastic support stockings. Varicose veins are veins in the leg which become enlarged (engorged) causing aches and may be unsightly. Venous blood must be pushed against gravity, when the person is standing, and against the column of blood in the veins. The blood is pushed by the leg muscles and passes through a series of one-way valves. If an individual with varicose veins should be on a lower body exercise program, for example, a jogging, treadmill or stair-master type of exercise program, the person may injure or harm his/her veins. For this reason other types of exercise, such as swimming, are often advised for people with varicose veins, although such alternative exercise may be less beneficial.

In addition it is known that it may be useful, especially following surgical operation or for chronic angina, to move blood by external means, such as tubular bladders placed on a limb. Patents showing such blood moving bladders include: U.S. Pat. No. 4,338,923 entitled "Inflatable-Cell Type Body Treading Apparatus", to Gelfer et al; U.S. Pat. No. 3,811,431 entitled "Programmed Venous Assist Pump", to Apstein; U.S. Pat. No. 4,311,135 entitled "Apparatus To Assist Leg Venous and Skin Circulation" to Brueckner et al; and U.S. Pat. No. 4,013,069 entitled "Sequential Intermittent Compression Device" to Hasty and the applicant Horace Bullard's prior U.S. Pat. Nos. 4,865,020 and 5,027,797 and his PCT Application 91911528.7, the Bullard U.S. patents being incorporated by reference herein. In those patents there is no disclosure of obtaining a rise in heart rate to at least 20% above the person's normal rate, or the use of pure oxygen along with the vascular and physical exercise.

Other patents showing the use of air inflated bags on the human body include: U.S. Pat. No. 1,680,239 to Rosett entitled "Therapeutic Device"; U.S. Pat. No. 3,880,149 to Kawaguchi entitled "Blood Circulation Stimulating Apparatus"; U.S. Pat. No. 3,659,593 to Vail, entitled "Cardiovascular Assist Device"; U.S. Pat. No. 3,886,604 to Curless et al, entitled "External Cardiac Assistance"; U.S. Pat. No. 3,179,106 to Meredith, entitled "Method And Apparatus For Preventing Venous Blood Clotting" and U.S. Pat. No. 4,624,244 to Taheri entitled "Device For Aiding Cardiocepital Venous Flow From The Foot and Leg Of A Patient."

The use of Enhanced External Counterpulsation (EECP) as a therapy for selected patients with chronic angina is reviewed in the article "Efficacy of Enhanced External Counterpulsation in the Treatment of Angina Pectoris" Lawson et al, *Am.J. Cardiol*, 1992, 70:859–862. In that study the patients lie down with three sets of balloons wrapped about their calves and thighs with the timing of the sequential compression being controlled by the patient's electrocardiogram.

It has been reported that a new Harvard study which followed 17,300 middle-aged men for 20 years found that only vigorous exercise had a beneficial effect on longevity (New York Times, pg. 1, Apr. 19, 1995).

The present invention provides an apparatus and method which combines vigorous physical exercise and vascular exercise. It is believed that there is a strong beneficial effect, in terms especially of cardiovascular fitness, from vigorous and prolonged exercise such as jogging, cross-country skiing or using exercise equipment. However, such vigorous exercise may not be performed by infirm or elderly persons. The applicant believes that increasing the amount of blood in the trunk of the body, holding the blood under pressure in the trunk and simultaneously performing physical exercise can yield beneficial results. He believes the beneficial results from such a physical exercise program and vascular exercise program would be more beneficial than the results from vigorous exercise. The benefits are believed to include improved capillary circulation, which provides better skin tone and better functioning of the liver and lymph systems. The system and method of the present invention may also be useful for persons with inadequate blood circulation, such as blood capillary circulatory problems, and collapsed or narrowed veins and varicose veins and angina pectoris. It permits persons with varicose veins to perform lower body exercise such as jogging, treadmill, etc.

SUMMARY OF THE INVENTION

In accordance with the apparatus of the invention pressure applying cuffs (bladders) are applied around all four limbs of a person and at the buttock area.

In one embodiment the person performing the exercise may sit down in the apparatus, adjust the exercise program and the cuff sizes to his/her needs, and commence the blood exercise program. The apparatus, similar in some respects to the apparatus of Bullard U.S. Pat. No. 5,027,797, includes a base member, in which the person sits, and a top member which he swings down on the base member. The timing and the pressure of the air injected into the cuffs is controlled by a microprocessor based control means coupled to the four limb pressure cuffs. The microprocessor is connected to a device, such as a simple heart rate earlobe monitor, which detects the user's diastolic beat. In one embodiment the cuffs may be almost fully inflated during the user's systolic pressure period and then fully inflated, to apply a pressure triggered by the user's diastolic beat.

Each of the four limb pressure cuffs consists of a series of individual cuffs, i.e., differently actuatable sections, arranged around each limb in an array extending along the limb. The control means has sequencing means for activating the cuffs on the limbs to apply pressure in a sequence to obtain a peristaltic-like movement. The cuffs are inflated in sequence from the cuff nearest the limb extremity (hand or foot) to the cuff nearest the trunk in order to force the blood toward the heart. In various embodiments the arm members are slidable, or free to move, so that the user pumps the arm members back and forth, or up and down against a selected force, for physical exercise. The objective of the physical exercise, which preferably is a vigorous physical exercise, is to obtain a heart rate of at least 25% above the normal resting heart rate, i.e., for a normal resting heart rate of 80 to obtain a heart rate of 100–120 beats per minute simultaneously with movement of the blood into the trunk. The heart rate should be above 70% of the user's maximum and would be about the same as that obtained by jogging or brisk walking. Simultaneously and preferably, the person inhales pure oxygen through a nose clip leading to a metered oxygen tank. The oxygen will oxygenate the "old" or "stale" blood from the limbs to provide renewed circulation of that blood.

The following procedure is followed by a person with varicose veins preferably at least 4–6 weeks and preferably on a daily schedule for about one hour each day. The user walks rapidly on a conventional motor driven treadmill as his physical exercise program until the user's heart rate is at least 25% above his/her normal rate. Preferably, at that time, first each of the legs is placed under pressure, in sequence, and then each of the arms is placed under pressure, in sequence, and the pressure is held on all four limbs for at least 20 seconds, and less than 120 seconds. The buttock muscle exerciser bladder is pulsed with air pressure, preferably in another separate procedure as part of each cycle, while the pressure is held on all the limbs. Then the pressure is released. After 30 seconds to 60 seconds, the pressure is reapplied in the same sequence. This is repeated for 5–30 cycles, and preferably 20 cycles for a one-hour session. The pressure is applied so that blood is placed under pressure in the trunk for 5 to 30 times each session. The person keeps walking on the treadmill and maintains his heart rate at least 25% above normal for the entire exercise period, of 20 to 90 minutes, preferably about one hour.

In other embodiments an apparatus has back and forth arm motions or sideways arm motions or the arm members may be free to be moved vertically. The user pumps the arm members against a selected force either back and forth or up and down or sideways for vigorous physical exercise. Simultaneously the blood is pumped toward the trunk, as in the prior embodiment, and preferably the person simultaneously breathes pure oxygen from an oxygen tank.

In still another embodiment, the user sits in an exercise machine, for example, a stationary bicycle exercise machine, and performs a physical exercise to obtain a heart beat rate of at least 25% above normal and continues to exercise simultaneously with the application of pressure to the four limbs, using air bladders and a peristaltic-like sequence of the bladders on each limb.

BRIEF DESCRIPTION OF THE DRAWINGS

The invention will be better understood after reading the following detailed description of the presently preferred embodiments thereof with reference to the accompanying drawings, in which.

DETAILED DESCRIPTION

As shown in FIG. 1A, four groups of pressure cuffs (air bags, balloons or air bladders) 10*a*–10*d* are applied to all four limbs of a person. The group of cuffs 10*a*, 10*b* are applied to the left and right legs, respectively, and the group of cuffs 10*c*, 10*d* are applied to the left and right arms, respectively. In addition, air bags 10*e* (1E, 2E, 3E) are applied to the person's back, preferably up to the level of the shoulders, and air bags 8A, 8B about the feet and air bags 9A, 9B about the ankles.

Figure 1:
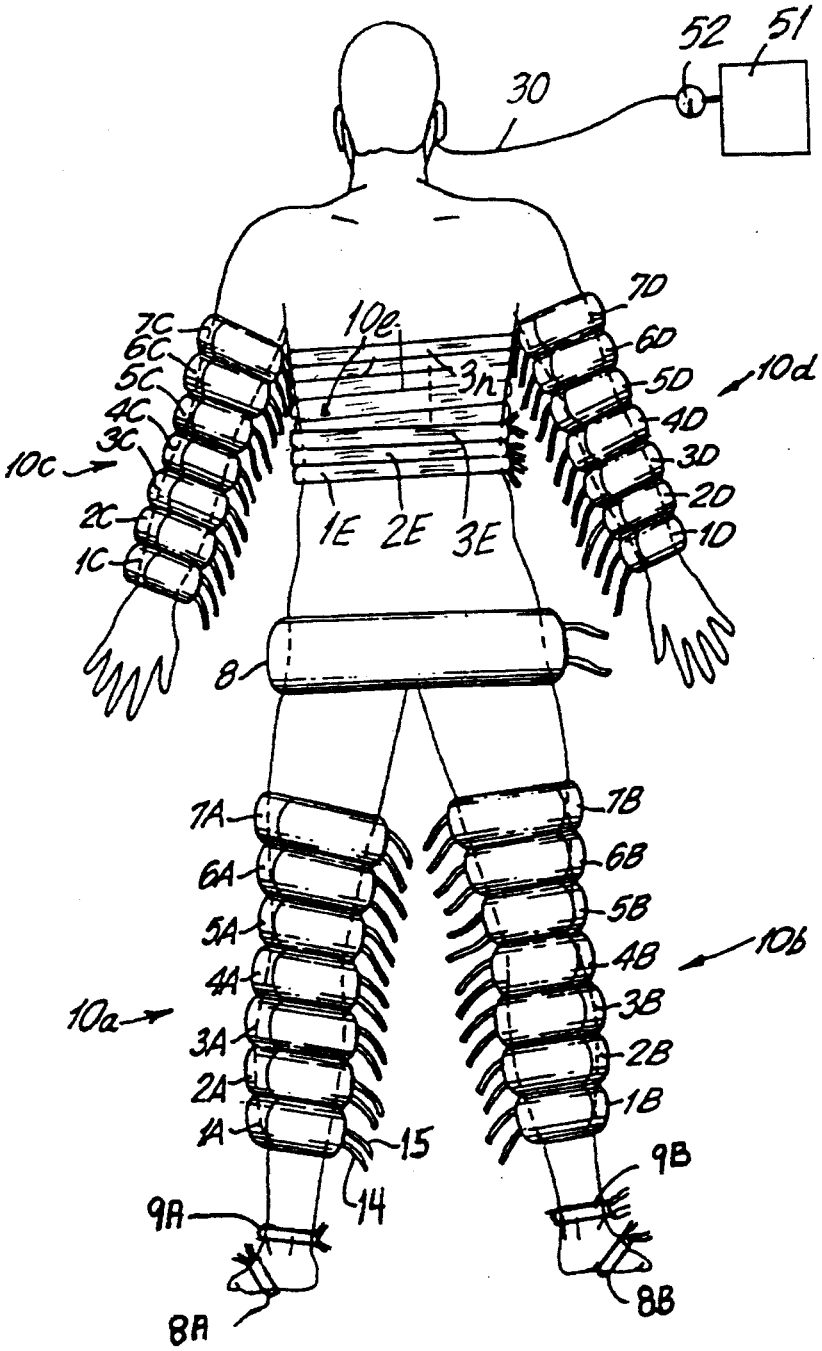
FIG. 1 is an illustration of the present invention applied to the legs and arms and back of a human.

In addition, a large inflatable cuff (buttock exerciser) 8 is positioned at the area of the buttocks. The leg and arm cuffs are inflated, in sequence, starting from the feet or hands, to squeeze the blood toward the heart. The expansion of the cuffs causes a flow of blood toward the trunk and head of the body. Their pressure is maintained for at least 20 seconds and preferably less than 60 seconds. The function of the apparatus of FIG. 1 is to squeeze the blood from both legs and both arms into the trunk. This process is like the squeezing of a flexible tube of toothpaste with the cap on. At that time, while the pressure is maintained in the arm and leg cuffs, the buttock cuff 8 is inflated and pulsed with preferably 1–3 seconds on and off in repeated cycles, to provide cycles of pressure at the buttock area. Each of the cuffs, identified by the numbers 1A to 7A, 1B to 7B, 1C to 7C, 1D to 7D and 1E to 3E is an air bag or air bladder and is similar to a sphygmomanometric cuff having an expandable bladder confined within a fabric binder. Each cuff can be wrapped around the limb and held in place by a hook and loop fastener or the like. Each cuff, such as cuff 1A in set 10*a*, has connecting tubes 14 and 15, one for introducing pressurized air and the other for exhausting (venting) the cuff. The limb cuffs may all be of the same basic size and rely upon the adjustment afforded by the fastener, or they may be sized to locate each in a specific position in the array.

The air pressure is preferably in the range of 1–12 lbs./sq.in. and most preferably 4–8 lbs./sq.in.

The process of squeezing starts at the bottom of the left leg by inflating cuff 1A thereby squeezing the leg. With cuff 1A staying inflated, cuff 2A is inflated. This process continues until all seven cuffs 1A–7A have been inflated in sequence 1A, 1B, 1C, etc. Then the cuffs 1B–7B of the right leg are inflated. Then the cuffs on each of the arms, in turn, are inflated in the same sequence. All the cuffs must remain closed and inflated at the same time so that no blood can return to the legs or arms. That keeps maximum pressure in the balance of the body, i.e., the trunk and head, until the cycle is over. Preferably complete inflation of all cuffs is maintained for at least 20 seconds and less than one minute.

The Benefits of Using Oxygen During the Exercise Cycle

The sequential air bag inflation squeezes the limbs and moves pooled blood (old blood) from the veins to the limbs to the heart. The heart pumps that blood into the lungs where it picks up oxygen. This blood, however, is deoxygenated (poor blood) because the blood in the limbs has difficulty in being pumped into the main circulation, especially where the individual has defective venous valves. Defective venous valves cause blood pooling and blood stagnation in the limbs. As a result, when this blood is squeezed by the sequential air bags out of the limbs to the heart and then to the lungs, this blood is old and very poor and requires high volumes of concentrated oxygen to become fully oxygenated. There is no other circumstance under which such an opportunity to oxygenate the blood from the limbs may be achieved.

Under no other circumstances will the human body have the opportunity to saturate all the blood of the body with oxygen, as when one is breathing pure oxygen during the vascular exercise.

As shown in FIG. 1, the system provides a nose tube 30 to be placed in the user's nose which supplies oxygen from the oxygen tank 51 through the metering valve 52 to the user while the user exercises and the inflation air bags are operating. Alternatively, oxygen may be provided to the user by having him perform exercise within a closed room which is enriched with oxygen; or by the user wearing a transparent bubble or facial mask having a tube leading to a supply of oxygen. As a result, the large amount of blood being pumped and passing through the lungs allows for the maximum amount of blood to be oxygenated. That oxygenated blood is pumped into the arterial sector of the vascular system, thus giving the maximum supply of oxygen from the lungs to the cells of the body.

The Importance of Lowering the Back to a Prone Position and Raising the Legs Above the Heart Combining physical exercise and sequential (air bag inflation) squeezing of the limbs, together with the lowering of the back rest to a prone position and the raising of the legs above the heart provides the maximum amount of blood being squeezed out of the veins of the limbs to the heart. The raising of the legs and the prone position are efficient for all subjects; however, it is a must for those subjects having ineffective venous valves. Defective venous valves defeat the benefits of the sequential squeezing air bags on the legs, because the ineffective leg valves allows the venous blood to flow back toward the legs and feet during the venting of the air bag inflation cycles. Elevation of the subject's legs prevents such backflow of blood.

Preferably additional cuffs (air bags) are used to squeeze the subject's entire leg starting at the toes. Sequentially squeezing the cuffs starting at the toes and moving forward to the feet and then the ankle provides the greatest amount of stimulation of the vast number of nerves in the foot, together with the benefit of blood being squeezed out of the veins in the foot. The air bags may form a continuous series of air bags on each leg starting with the toes and terminating at the trunk.

The Importance of Accelerating the Heart Rate Prior to the Squeezing of the Limbs The delayed timing of the inflation of the air bags until the heart rate has reached at least 25% above normal, 120 beats per minute (for a person with a normal heart beat rate of 80) produces the least resistance to the blood when the veins are being squeezed. The accelerated heart rate moves blood out of the veins at an accelerated rate, which causes the venous blood pressure to drop, making room for the newly squeezed blood. The delayed timing (starting the squeeze after the heart beat rate rises) also minimizes the chance that the heart becomes overloaded with too much blood at any one time.

To further protect against overloading the heart with too much blood at one time, there is provided a series of 7–9 air bags on each leg (preferably 8) and 4–8 on each arm (preferably 4). The progressive inflation of the bags moves small amounts of venous blood at a time toward the heart. This progressive inflation gives the heart time to pump the increased blood without overloading the heart.

After the first ten minutes of the cycles of exercise and air bag inflation, it is necessary to recline the subject's upper torso to a prone position and to elevate the legs for a complete milking of the blood in the veins of the legs to the heart.

This process is, in order, first increasing heart rate (causing the heart to beat at least 25% over normal); sequential (air bag inflation) squeezing of the limbs; lowering the back to a prone position; and elevating the legs. This process squeezes veins and yet prevents too much blood from entering the heart at any one time.

Figure 4:
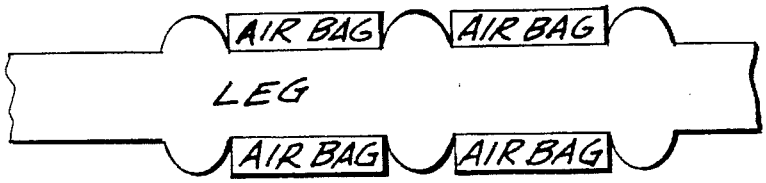
FIG. 4 is a side cross-sectional view showing an arrangement of the cuffs causing welts.

As shown in FIG. 4, if the cuffs (bags) do not overlap they may cause welts, i.e., squeezing the skin between the cuffs. Such trapping and squeezing of skin tissue between the cuffs may damage the trapped tissue and produce welts. Such welts are prevented by overlapping of the cuffs so that the skin is not squeezed between the cuffs.

Figure 2:
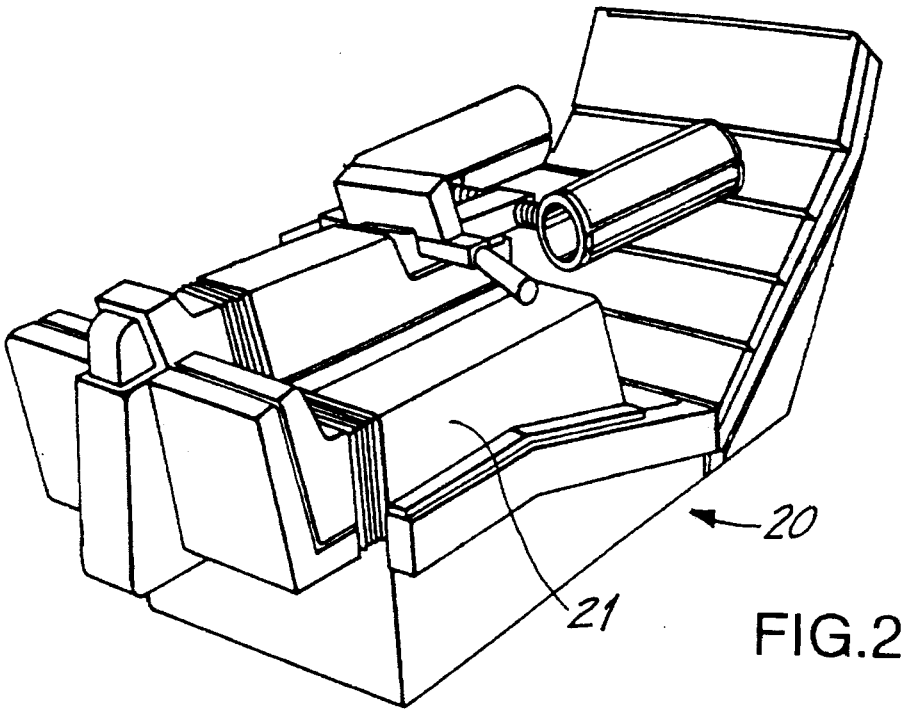
FIG. 2 is a perspective view of the apparatus of the present invention with its back in the upright position.
Figure 3:
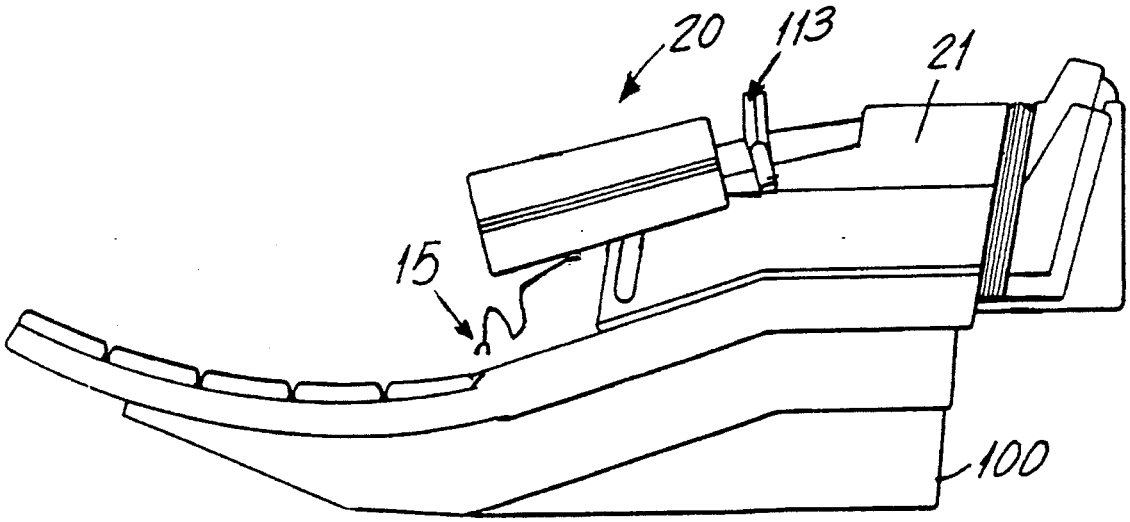
FIG. 3 is a side plan view of the apparatus of FIG. 2 with its back in the prone (down) position.
Figure 5:
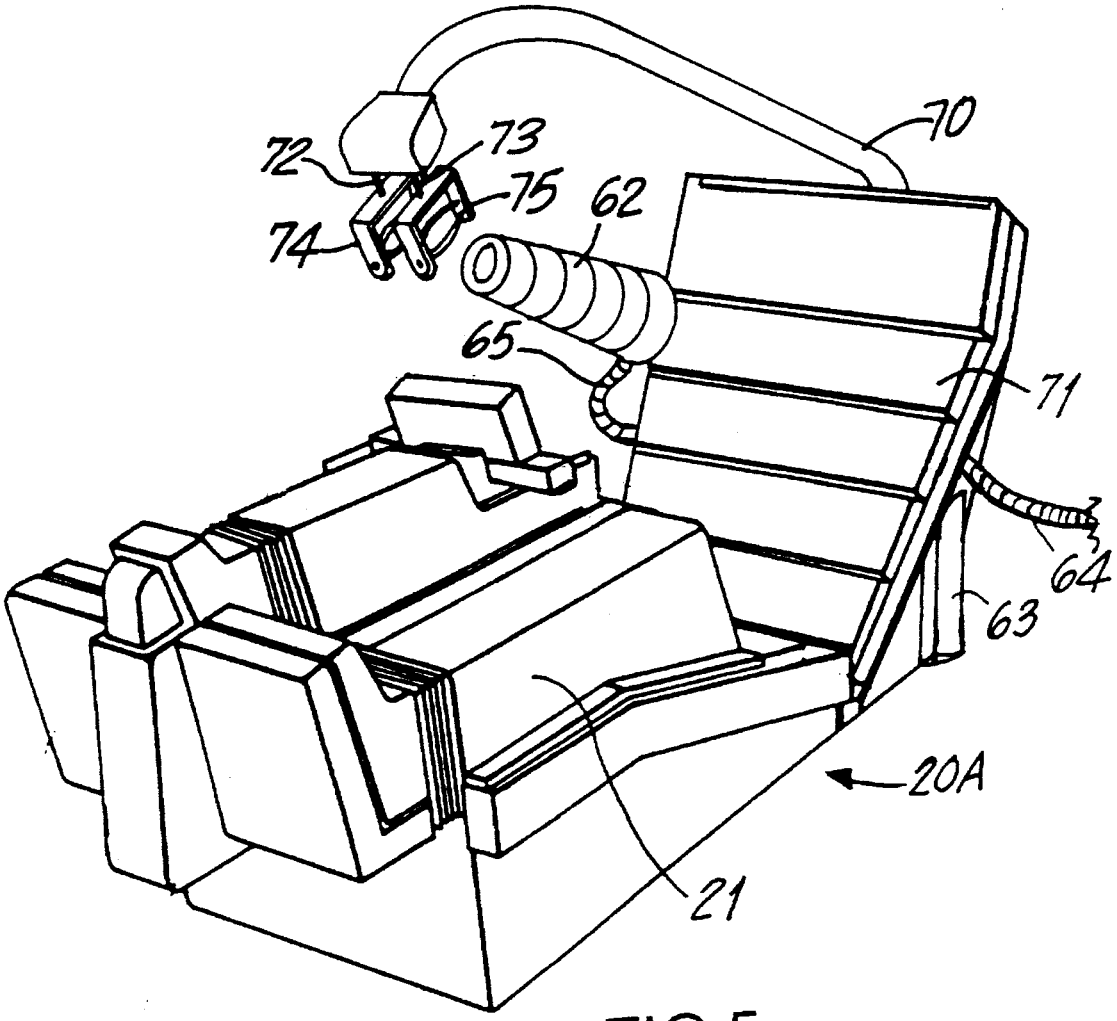
FIG. 5 is a side plan view of a vertical arm exercise device.
Figure 6:
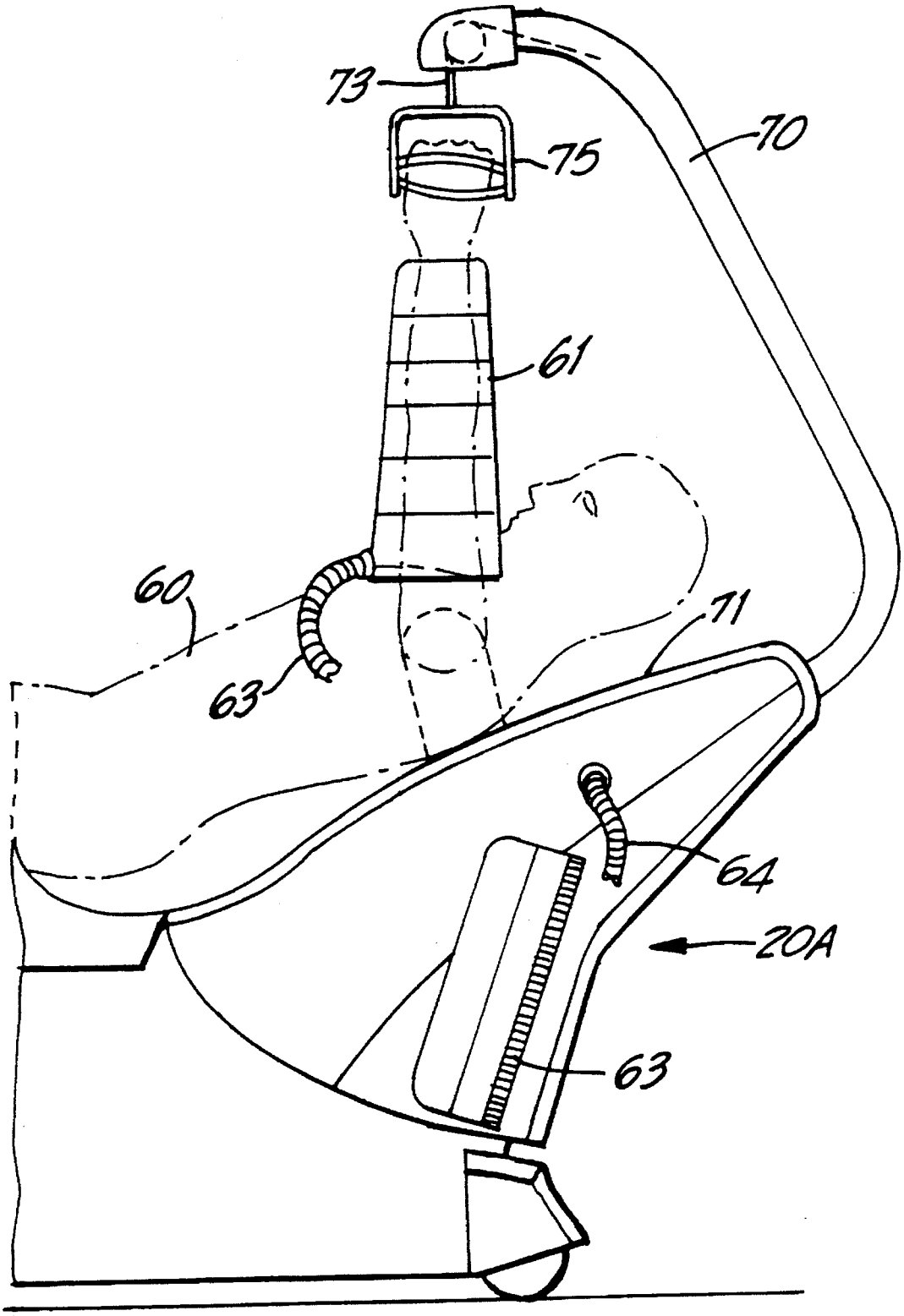
FIG. 6 is a perspective view of the device of FIG. 5.

Preferably, in order to obtain a vigorous physical exercise program, the user exerts is muscle force against a selected exercise machine force. As shown in FIGS. 5 and 6, the user 60 lies in the exercise machine 20A, of the type shown in FIGS. 1 and 2, except the arm tubes are not arranged for generally horizontal sliding motion. Instead, as shown in FIGS. 5 and 6, the arm tubes 61, 62 are not restrained in their movement but rather are separate devices. The arm tubes 61, 62 are stored, when not being used, in the wireform holders 63. Air hoses 64, 65 lead from the machine 20A to the left and right arm tubes 61, 62. Each air hose 64, 65 contains a bundle of air lines, with two lines leading to each cuff, one for inflation (air pressure) and one for deflation (partial vacuum). Each arm tube 61, 62 is flexible and is openable and closable and contains a series of inflatable cuffs.

A tubular metal arm 70 extends above the back 71 of the machine 20A and contains two cables 72, 73. The cables 72, 73 extend beyond the arm 70 and are connected to pull grips 74, 75 respectively. The cables at their opposite ends (not shown), inside of machine 20A, are connected to weights or to a spring mechanism. The weights or spring mechanism may be adjusted to provide a selected resistive force to the user's pulling down of the pull grips 74, 75.

In operation, the user 60 sits in the machine 20A and places his legs in the left and right leg compartments 21 (as in machine 20 of FIG. 2); places the arm tubes 61, 62 on his arms and places a wire clip 15 on his earlobe to monitor his heart rate. He then grasps the pull grips 74, 75 with his left and right hands and begins his physical exercise program by pulling the pull grips 74, 75 downwardly against the selected resistive force.

Five examples of suitable programs are as follows:

EXAMPLES

To start the exercise programs of Programs 1–5 set forth below an individual sits in the vascular exerciser machine 20 or 20*a* (FIGS. 2 or 5) in a "sit-up" position with the legs in a 90° position relative to the trunk. A lid 21 is then closed down on the legs, thereby encapsulating the legs with a series of two semicircle air bags, circling the legs.

The individual then proceeds to start the machine by turning on a switch. A screen panel 113 will light-up, identifying several optional programs.

PROGRAM #1

Before beginning the exercise program the user places a wire clip 15 (which is attached to the machine) onto the right earlobe to monitor his heart rate. His arms are placed in the left and right sleeves of the machine (either machine 20 or 20A). He then grasps the operating handles and proceeds to do lift and stretch exercises. When his heart rate reaches 120 (the "heart plus rate") the machine 10 will start the air bag inflation cycles. In this example, as in the other examples, it is assumed that the person has a normal heart rate of about 80. If his normal rate is higher, then the exercise heart plus rate will be adjusted. If at any time during the cycle the heart plus rate drops below 120 the machine sounds an alarm to indicate that the individual should resume his lifting exercises.

After 10 minutes of this program the individual is allowed to rest for 10 minutes while the air bag inflation cycles continue. After 10 minutes of test the program starts again, requiring the individual to again perform physical exercise.

PROGRAM #2

The individual sits in the machine 20 or 20*a* as in Example 1 and begins this exercise program by placing a wire clip 15 (which is attached to the machine 20) onto his right earlobe to monitor his heart rate. He then places his arms in the left and right sleeves of the machine. He then grasps the operating handles and proceeds to do lift and stretch exercises. When his heart plus rate reaches 120 the machine will start the air bag inflation cycles. If at any time during the cycle his heart plus rate drops below 120 the machine sounds an alarm to indicate that the individual should resume his lifting exercises.

After 10 minutes of this program, the individual is allowed to rest for 10 minutes. At that time the back rest of the seat reclines to a prone position while the air bag inflation cycles continue. After the 10-minute rest period expires the program starts again, requiring the individual to again exercise; but in the prone position.

PROGRAM #3

The individual sits in the machine 20 or 20A, as in Example 1 and begins the exercise program by placing a wire clip 15, which is attached to the machine 20, onto his right earlobe to monitor his heart rate. He then places his arms in the left and right arm sleeves of the machine. He then grasps the operating handles and proceeds to do lift and stretch exercises. When his heart plus rate reaches 120, the machine will start the air bag inflation cycles. If at any time during the air bag inflation cycle the heart plus rate drops below 120 the machine sounds an alarm to indicate that the individual should resume his lifting exercises.

After 10 minutes of this program the individual is allowed to rest for 10 minutes. At that time the back rest of the seat reclines to a prone position and the legs are elevated above the heart level. The air bag inflation cycles continue. After the 10-minute rest period expires the individual exercises again, by lift and stretch exercises, in the prone position and with the legs in the elevated position.

PROGRAM #4

The individual sits in the machine 20 or 20*a* as in Example 1 and begins the exercise program by placing the wire clip 15 (which is attached to the machine 20) onto the right earlobe to monitor his heart rate. He then places his arms in the left and right arm sleeves on the machine. He then grasps the operating handles and proceeds to do lift and stretch exercises. When his heart plus rate reaches 120 the machine will start the air bag inflation with random massage cycles, i.e., it does not inflate the air bags in sequence, but inflates and deflates each bag at random. If at any time during this random massage cycle the user's heart plus rate drops below 120, the machine sounds an alarm to indicate that the individual should resume his lifting exercises.

After 10 minutes of this program the individual is allowed to rest for 10 minutes while the random air bag inflation cycles continue. After the 10 minutes of rest expires, the program requires the individual to exercise again.

PROGRAM #5

The individual sits in the machine 20 or 20*a,* as in Example 1 and begins this exercise program by placing a wire clip 15 (which is attached to the machine 20) onto his right earlobe to monitor his heart rate. He then places his arms in the left and right arm sleeves of the machine. He then grasps the operating handles and proceeds to do lift and stretch exercises. When his heart plus rate reaches 120 the machine will start the air bag inflation with random massage cycles. If at any time during the random massage cycle his plus rate drops below 120, the machine sounds an alarm to indicate that the individual should resume the lifting exercises.

After 10 minutes of this program, the individual is then allowed to rest for 10 minutes. At that time the back rest of the seat reclines to a prone position and his legs are elevated above the heart level, while the air bag inflation random massage cycles continue. After the 10-minute rest period expires the program continues, requiring the individual to again exercise in the prone position and with his legs in the elevated position.

In all programs the machine also will sound an alarm if the user's plus rate exceeds 180 at any time.

What is claimed is:

1. A method of vascular exercise for a human subject comprising the following steps:

(a) providing a physical exercise-vascular pressure machine having an exercise mechanism for monitoring the subject's heart rate and an inflation mechanism including a series of bladders adapted to be positioned around at least two of the subject's limbs;

(b) positioning the subject into the physical exercise-vascular pressure machine and attaching the series of bladders about at least two of the subject's limbs;

(c) having the subject perform a physical exercise in the physical exercise-vascular pressure machine and monitoring the subject's heart rate until the subject's heart rate is at least 25% above the subject's normal heart rate; and (d) immediately thereafter, in the same physical exercise-vascular pressure machine, squeezing at least two of the subject's limbs to move blood toward the subject's trunk by inflation, with at least 4 lbs./sq.in. pressure, and deflation of the series of inflatable bladders which are positioned around at least two of the subject's limbs.

2. The method of vascular exercise as in claim 1 and in addition providing oxygen to be inhaled by the subject while the subject is performing the physical exercise of (c).

3. The method of vascular exercise as in claim 1 wherein the step of (d) is repeated for at least 5–30 cycles during a period and the inflation of the bladders is sequential starting with bladders furthest from the trunk.

4. The method of vascular exercise as in claim 1 wherein the inflatable tubular bladders are positioned on all four limbs of the subject and the bladders on each limb are inflated in sequence starting from the bladder furthest from the trunk.

5. The method of vascular exercise as in claim 1 wherein the physical exercise is continued for a period of 20 to 90 minutes simultaneously with a series of inflations and deflations of the tubular bladders.

6. The method of vascular exercise as in claim 1 wherein the sequence of inflation of the bladders on each limb creates a peristaltic-like movement of blood toward the subject's trunk.

7. The method of vascular exercise as in claim 1 wherein a nose clip is removably attached to the subject's nose to feed oxygen to the subject during the exercise of (c).

8. The method of vascular exercise as in claim 1 wherein each of the subject's limbs has a series of said bladders and the cycle is followed in (d) that each of the legs is placed under bladder pressure and then each of the arms is placed under bladder pressure and the bladder pressure on all four limbs is held between 20 and 120 seconds and then the pressure on all four limbs is released and that this cycle of (d) is repeated 5–30 times during a period.

9. The method of vascular exercise as in claim 5 wherein the subject lifts and lowers his arms or swings them sidewise in the physical exercise-vascular pressure machine against a force.

10. The method of vascular exercise as in claim 1 and including during (d) exerting pressure on the subject's buttocks by inflation of a bladder proximate to the buttocks.

11. The method of vascular exercise as in claim 1 wherein each of the bladders is kept fully inflated for 20–60 seconds and then deflated.

12. The method of vascular exercise as in claim 1 wherein during (d) the subject is positioned to lie prone with the subject's legs elevated above the subject's head to prevent backflow of the blood to the legs.

13. The method of vascular exercise as in claim 12 and inflating and then deflating additional air bladders positioned about the feet and ankles, the additional air bladders being inflated prior to inflation of the air bladders on the limbs.

14. A method of vascular exercise for a human subject, comprising the following steps to be performed over an exercise period of 20–90 minutes:

(a) having the subject perform physical exercise and monitoring the subject's heart rate until the subject's heart rate is at least 25% above the subject's normal heart rate; and (b) thereafter squeezing at least two of the subject's limbs to move blood toward the subject's trunk by inflation of a series of inflatable tubular bladders which are positioned around the subject's limbs and deflating the bladders;

(c) simultaneously with (b) having the subject perform physical exercise and monitoring the subject's heart rate to maintain the subject's heart rate at least 25% above the subject's normal heart rate.

15. The method of vascular exercise as in claim 14 and in addition feeding oxygen to be inhaled by the subject while the subject is performing the physical exercise.

16. The method of vascular exercise as in claim 14 wherein the inflation of the bladders is sequential starting with bladders furthest from the trunk.

17. The method of vascular exercise as in claim 16 wherein the inflatable tubular bladders on each limb are inflated in sequence, starting from the bladder furthest from the trunk and then deflated and then inflated and deflated in random.

18. The method of vascular exercise as in claim 14 wherein the sequence of inflation of the bladders on each limb creates a peristaltic-like movement of blood toward the subject's trunk.

19. The method of vascular exercise as in claim 14 wherein a nose clip is removably attached to the subject's nose to feed oxygen to the subject during the exercise of (a) and (c).

20. The method of vascular exercise as in claim 14 wherein each of the subject's limbs has a series of said bladders and the sequence is followed that each of the legs is placed under bladder pressure and then each of the arms is placed under bladder pressure and the pressure on all four limbs is held between 20 and 120 seconds and then the pressure on all four limbs is released.

21. The method of vascular exercise as in claim 14 wherein in (d) and (e) the subject lifts and lowers his arms or swings them sidewise in a physical exercise - vascular pressure machine against a force wherein the physical exercise-vascular pressure machine includes an exercise mechanism to provide resistance against exercising, a mechanism for monitoring the subject's heart rate and an inflation mechanism including the series of bladders adapted to be positioned around the subject's limbs.

22. The method of vascular exercise as in claim 14 and including during (b) exerting pressure on the subject's buttocks by inflation of a bladder.

23. The method of vascular exercise as in claim 14 wherein each of the bladders is kept fully inflated for 20–60 seconds and then deflated.

24. The method of vascular exercise as in claim 14 wherein the subject lies prone during (b) with the subject's legs elevated above the subject's head to prevent backflow of the blood to the legs.

25. The method of claim 24 and inflating additional air bladders positioned about the feet and ankles, the additional air bladders being inflated prior to inflation of the air bladders on the limbs.

26. A method of vascular exercise for a human subject comprising:

(a) providing a physical exercise-vascular pressure machine having an exercise mechanism to provide resistance against exercising, a mechanism for monitoring the subject's heart rate and an inflation mechanism including a series of bladders adapted to be positioned around at lease two of the subject's limbs;

(b) positioning the subject into the physical exercise-vascular pressure machine and attaching the series of bladders about at least two of the subject's limbs;

(c) having the subject perform a physical exercise in the physical exercise - vascular pressure machine and monitoring the subject's heart rate until the subject's heart rate is at least 25% above the subject's normal heart rate;

(d) providing oxygen and having the subject inhale the oxygen while the subject is performing the physical exercise of (c);

(e) immediately after the physical exercise of (c), in the same physical exercise - vascular pressure machine, squeezing the subject's limbs to move blood toward the subject's trunk by inflation and deflation of the series of the inflatable bladders which are positioned around at least two of the subject's limbs, the inflation of the bladders being sequential starting with the bladders furthest from the subject's trunk.

* * * * *